US006298543B1

(12) United States Patent
Shore et al.

(10) Patent No.: US 6,298,543 B1
(45) Date of Patent: Oct. 9, 2001

(54) RIVETING TOOL AND METHOD TO REDUCE MARRING OF THE WORKPIECE

(76) Inventors: Douglas A. Shore; Judith Gertrude Bartlett, both of 83 Simkin Drive, Winnipeg, Manitoba (CA), R2P 2V6

( * ) Notice: Subject to any disclaimer, the term of this patent is extended or adjusted under 35 U.S.C. 154(b) by 0 days.

(21) Appl. No.: 09/485,766

(22) PCT Filed: Aug. 28, 1998

(86) PCT No.: PCT/CA98/00813

§ 371 Date: Feb. 17, 2000

§ 102(e) Date: Feb. 17, 2000

(87) PCT Pub. No.: WO99/11401

PCT Pub. Date: Mar. 11, 1999

Related U.S. Application Data

(63) Continuation-in-part of application No. 08/920,860, filed on Aug. 29, 1997, now abandoned.

(60) Provisional application No. 60/082,948, filed on Apr. 24, 1998.

(51) Int. Cl.[7] ..... B21J 15/02

(52) U.S. Cl. ..... 29/525.06; 29/243.53; 81/180.1; 72/478

(58) Field of Search ..... 29/243.53, 524.1, 29/525.06, 423, 243.54; 81/185, DIG. 11, 180.1; 72/478

(56) References Cited

U.S. PATENT DOCUMENTS

| | | | | |
|---|---|---|---|---|
| 3,067,790 | | 12/1962 | Tucker . | |
| 3,069,946 | * | 12/1962 | Zilliox | 81/185 |
| 3,229,738 | | 1/1966 | Bianchini . | |
| 3,298,261 | | 1/1967 | Lynn . | |
| 3,433,108 | * | 3/1969 | Ondeck | 81/185 |
| 3,634,928 | | 1/1972 | Falcioni . | |
| 3,901,296 | | 8/1975 | Tomac . | |
| 4,060,189 | | 11/1977 | Vargo, Jr. et al. . | |
| 4,133,096 | | 1/1979 | Falcioni . | |
| 4,373,565 | * | 2/1983 | Soto | 81/19 |
| 4,455,898 | * | 6/1984 | Marboug, Jr. | 81/185 |
| 4,581,962 | * | 4/1986 | Marboug | 81/185 |
| 4,630,463 | | 12/1986 | Knowlton . | |
| 4,836,067 | | 6/1989 | Rogers et al. . | |
| 4,979,355 | | 12/1990 | Ulevich . | |
| 5,009,133 | * | 4/1991 | Carey | 81/185 |
| 5,060,362 | | 10/1991 | Birke et al. . | |
| 5,222,289 | | 6/1993 | Michalweski et al. . | |
| 5,531,009 | | 7/1996 | Givler . | |
| 5,671,521 | | 9/1997 | Briles . | |
| 6,138,538 | * | 10/2000 | Neijndorff | 81/185 |

* cited by examiner

*Primary Examiner*—S. Thomas Hughes
*Assistant Examiner*—T. Nguyen
(74) *Attorney, Agent, or Firm*—Adrian D. Battison; Michael R. Williams

(57) ABSTRACT

A riveting tool having a generally cylindrical tool head with a front face for engaging the rivet head is modified by the addition of a sheath engaged over the tool head which is integrally molded from a plastics material. The sheath has a generally cylindrical sleeve portion engaged over a part of the cylindrical portion of the tool head and a front portion shaped to substantially fully cover and match the front face of the tool head. The sheath is shaped to provide a readily removable and replaceable friction fit on the tool head and has a thickness at the front portion which is sufficiently thin to allow forces to be communicated from the tool head to the rivet head to effect driving of the rivet for attachment of the rivet to a material to be riveted and which is sufficiently thick to inhibit marring of the rivet and the material adjacent the rivet. The sheath has a peripheral rib at the edge for manually grasping and at least one raised projection on an inside surface thereof for engaging and providing a friction fit with the cylindrical portion of the tool head.

6 Claims, 3 Drawing Sheets

RIVETING TOOL AND METHOD TO REDUCE MARRING OF THE WORKPIECE

This application is a Continuation-in-Part Application of application Ser. No: 08/920,860, filed Aug. 29$^{th}$, 1997 now abandoned and claims the benefit under 35 U.S.C. Section 119(e) of United States provisional application Ser. No: 60/082,948, filed Apr. 24, 1998.

This invention relates to a modified tool head and method for use thereof for riveting tools which can reduce the possibility of marring of the rivet or the material to be riveted adjacent the rivet.

BACKGROUND OF THE INVENTION

This new conceptual product design resulted from personal experience in the aviation sheet metal industry. Differences in hardness factors between the job tool [rivet gun and detachable snap head] and the material being used [rivets (aluminium) and skins (usually aluminium but often composites)] have always necessitated the continual need to intermittently construct a taped protective surface for the snap portion of the tool. This tool is used for many hours each day. Without protection, the materials utilized in the job often become damaged and must be replaced, thus resulting in significant wastage of both material and work hours. I have clearly observed that this difficulty is experience by virtually all of the individuals who utilize this riveting tool.

Universal (round head) rivets are installed in a variety of methods, but can be divided into two groups, the squeeze type and the impact type methods. The squeeze riveter is either stationary or portable, normally relying on air pressure to compress a rivet. One jaw is stationary and serves as a bucking bar against the manufactured head while the movable jaw upsets the shank and forms the shop head. Compression riveters have their own special rivet sets.

An impact/rivet gun is a piston type tool. Air pressure drives a piston which in turn hammers on a snap or tool head in the rivet gun. In the riveting operation the shop head (or under surface of the rivet) is formed by placing a hardened steel bar against the exposed rivet shank to counter the pressure being applied by the rivet gun. This procedure forms the shop head. The accessibility of the rivets to be installed is not always ideal, thus rivet snaps are available in various sizes, shapes and lengths.

A technician in the field installing rivets is highly skilled, but an ongoing problem occurs. A wide variety of influences, but predominantly the angle of attack (i.e. the snap not being exactly perpendicular to the rivet and skin surface), causes marring, that is, marking or denting (smiles) to occur on either or both the skin and rivet head. This damage also removes the protective coating on the rivet and/or the skin surface thus increasing the chance of early corrosion. In severe cases the fasteners and/or the damaged skin must be repaired or replaced. Of more serious concern is the occurrence of stress risers which may result in cracks potentially leading to a compromise of structural integrity.

For years, in an attempt to reduce or avoid this problem technicians in the field have been applying tape (masking, electrical etc.) to the end of the rivet snap to provide a buffer zone. Taping is limited in that only a small number of fasteners can be installed before the snap requires re-taping. This procedure is quite time consuming and messy due to the adhesive.

It is known in regard to tools for impacting flush type rivets, that is rivets which provide a flat face coplanar with the finished material, that the tool face include a recessed rubber ring around the edge of the flat tools face. The majority of the rivet is therefore impacted by the metal inner portion of the tool head while the surrounding rubber ring which is flush with or slightly proud of the metal surface inhibits marring of the material surrounding the rivet.

A similar arrangement, in which the angle of attack can be varied, includes a tool head which is mounted on a support ball so that it can be swivelled to the required angle on the ball. The tool head is surrounded by a rubber sleeve which again is flush with the end face or slightly proud of the end face so as to provide a ring surrounding the end face.

In both of these arrangements, the rivet is impacted by the metal tool and the rubber ring surrounds the tool to reduce the possibility of marring.

However the solution is unsuitable for recessed head of a tool used for domed rivets or universal rivets and no solution for the marring effect of the tool for such rivets has been provided.

SUMMARY OF THE INVENTION

It is one object of the present invention to provide an improved method and tool for use in riveting which inhibits the possibility of marring of the rivet or surrounding material.

According to a first aspect of the invention there is provided a riveting tool comprising:

- a tool head shaped and arranged for engaging and driving a rivet head by pressure or impact;
- the tool head including a generally cylindrical body with a peripheral wall and a front face for engaging the rivet head, the front face having a central portion and a peripheral portion at or adjacent the peripheral wall;
- and a sheath engaged over the tool head;
- the sheath being integrally molded from a plastics material;
- the sheath having a generally cylindrical sleeve portion engaged over the peripheral wall of the tool head and extending thereon from the front face to an edge of the sleeve portion partly along the tool head;
- the sheath having a front portion shaped to cover at least the peripheral portion;
- the sheath being shaped to provide a readily removable and replaceable friction fit on the tool head so that the cylindrical sleeve portion is slideable over the front face onto the cylindrical portion to be maintained thereon by the friction fit;
- the sheath being arranged to allow forces to be communicated from the tool head to the rivet head to effect driving of the rivet for attachment of the rivet to a material to be riveted and the sheath being arranged such that the front portion at least at the peripheral portion is sufficiently thick to inhibit marring of the rivet and the material adjacent the rivet by the peripheral rib.

Preferably the sheath at the front face has a thickness less than 0.020 inch.

Preferably the sheath at the front face has a thickness which is sufficiently thin such that compression thereof by the forces is insufficient to cause material to be forced to the peripheral wall to cause splitting thereof.

Preferably the sheath is fully closed at the front portion.

Preferably the front portion of the sheath includes a central opening inward of the peripheral portion.

Preferably the sheath has a peripheral rib at the edge remote from the front portion for manually grasping the sheath.

Preferably the sheath has at least one raised projection on an inside surface thereof for engaging and providing a friction fit with the cylindrical portion of the tool head.

Preferably the thickness of the front portion of the sheath is substantially constant with an inside surface of the front portion directly in contact with the front face of the tool head.

Preferably the front face of the tool head includes a central recess at the central portion and a forwardly projecting peripheral rib at the peripheral portion and wherein the peripheral portion of the sheath covers the peripheral rib.

According to a second aspect of the invention there is provided a method of applying a rivet to a material to be riveted comprising:

providing a rivet having a shank and a rivet head;

providing a material to be riveted having a hole therein for receiving the shank of a rivet;

providing a riveting tool comprising a tool head shaped and arranged for engaging and driving the rivet head by pressure or impact;

applying forces to the tool head to apply forces to the rivet head to attach the rivet to the material at the hole;

and preventing marring of the rivet and the material adjacent to the rivet by engaging a sheath over the tool head during the application of forces to the rivet head;

the tool head including a generally cylindrical body with a peripheral wall and a front face for engaging the rivet head, the front face having a central portion and a peripheral portion at or adjacent the peripheral wall;

the sheath being integrally molded from a plastics material;

the sheath having a generally cylindrical sleeve portion engaged over the peripheral wall of the tool head and extending thereon from the front face to an edge of the sleeve portion partly along the tool head;

the sheath having a front portion shaped to cover at least the peripheral portion;

the sheath being shaped to provide a readily removable and replaceable friction fit on the tool head so that the cylindrical sleeve portion is slideable over the front face onto the cylindrical portion to be maintained thereon by the friction fit;

the sheath being arranged to allow forces to be communicated from the tool head to the rivet head to effect driving of the rivet for attachment of the rivet to a material to be riveted and the sheath being arranged such that the front portion at least at the peripheral portion is sufficiently thick to inhibit marring of the rivet and the material adjacent the rivet by the peripheral rib.

The sheath therefore simply slips over the end of the tool head or snap face providing a buffer between the hardened steel snap and the softer work materials. The sheath is manufactured in different sizes to accommodate the different sizes and shapes of the tool heads conventionally used.

The proposed material for the snap sheath would be, although not limited to, a thermal forming plastic of sufficient hardness to provide the semi-durable buffer zone. The sheath material must be softer than the snap, the rivet and skin material thus leaving no tooling marks. Testing of a 0.020 inch sheath material utilized with a 5/32 inch snap had the desired effect in providing the buffer with satisfactory durability and no damage to the materials. Advancements in materials could be made in sheath material to achieve the proper balance between durability, effectiveness in preventing marring and cost.

The length of time before replacement of the sheath is dependent on both size and number of fasteners being installed. When a sheath becomes worn, it is simply removed and a new sheath slipped on to the end of the snap.

The thickness of the material (thermal forming plastic) varies with the size of the rivet snap. For example, a sheath thickness of approximately 0.015 inch is typical in the shank area of all the snap sheath sizes. This area requires enough strength only to maintain its shape. With a few exceptions (gooseneck being one), the rivet snap shanks are 0.50 inch in diameter. Thus the inside diameter of the sheath will also be 0.50 inch with nibs or projections to create an interference fit.

The thickness of the sheath will increase or decrease relative to the snap size. The rationale for thickness varying with snap size is to accommodate the increase pneumatic pressure from the rivet gun required for the larger snap sizes. This adjustment of sheath thickness of the sheath for the larger size snaps would result in longevity of the snap sheath.

One should also note that sheaths are not interchangeable between different snap sizes; a 1/8 inch snap sheath is not used on a 5/32 inch snap or visa versa. Each sheath size is colour coded to prevent confusion or mix-up.

The length may vary to accommodate the shorter shaft length of the squeeze riveter but does not impact on function. A snap sheath length of 0.50 inch will accommodate ease of installation and removal from the snap head while at the same time ensuring utilization of the least possible quantity of thermoforming plastic materials required for manufacture.

BRIEF DESCRIPTION OF THE DRAWINGS

One embodiment of the invention will now be described in conjunction with the accompanying drawings in which.

DETAILED DESCRIPTION

Figure 1:
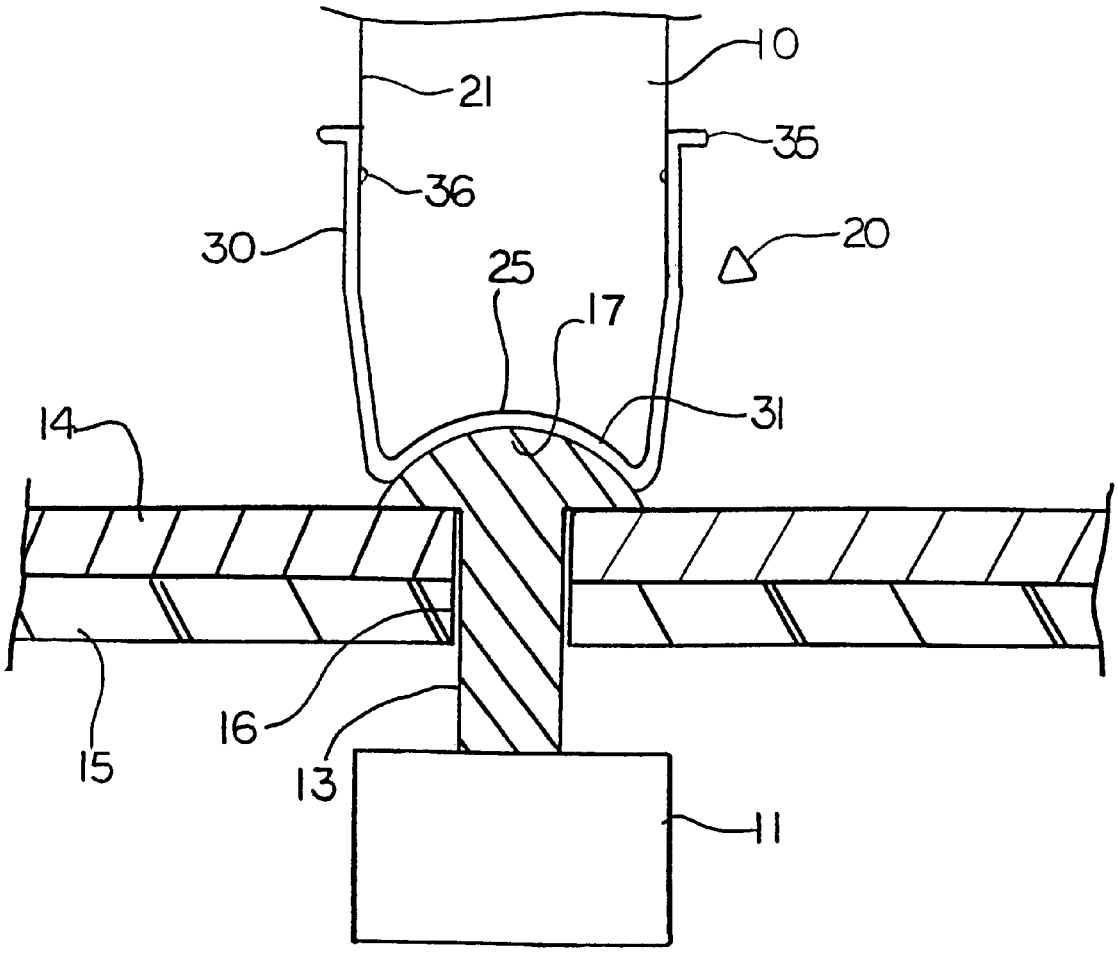
FIG. 1 is a vertical cross sectional view through a rivet, the materials to be riveted and a riveting tool according to the present invention.
Figure 2:
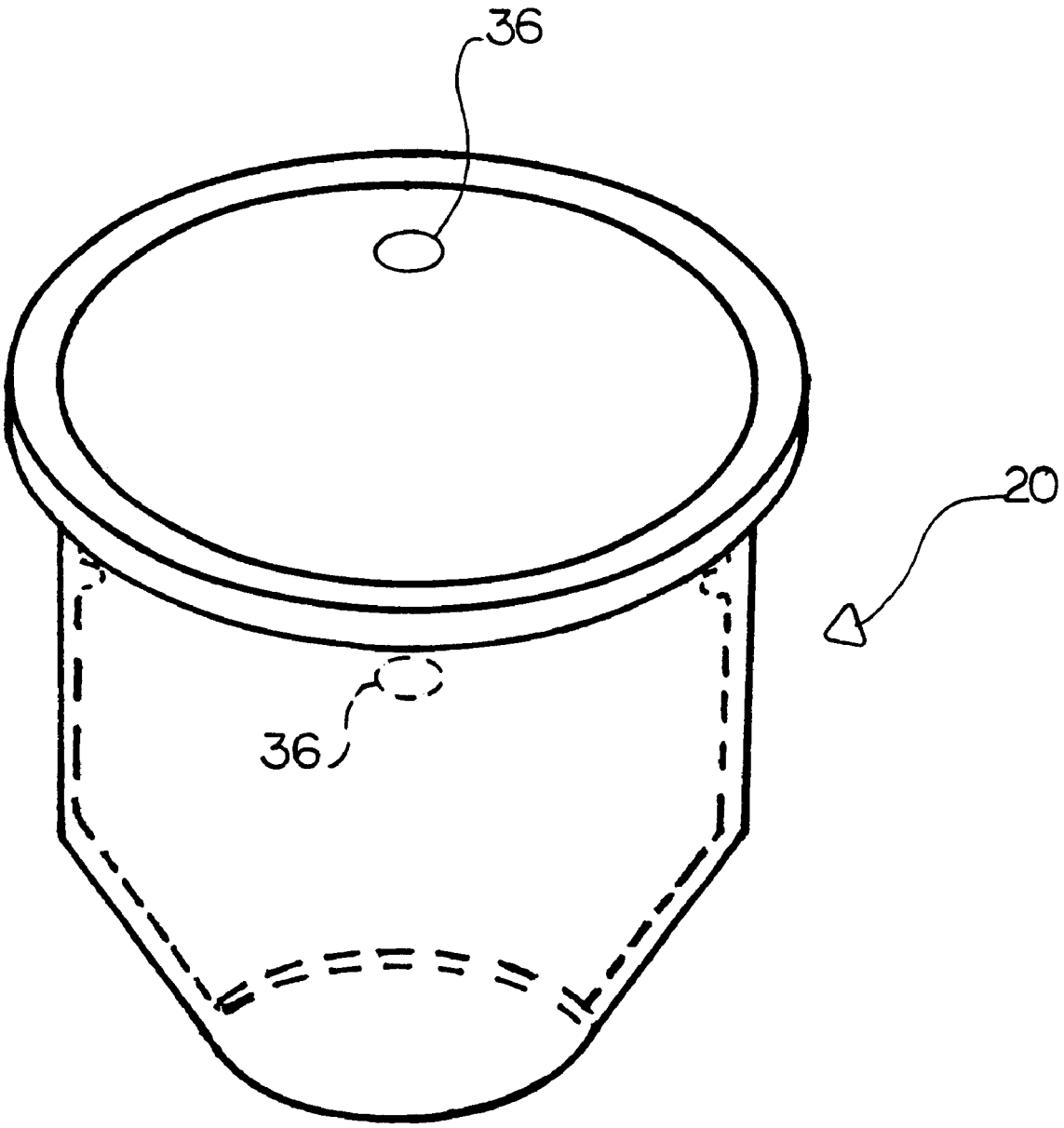
FIG. 2 is an isometric view showing the sheath for engagement over the conventional tool head or snap of the riveting tool.

The details of the riveting tool are shown only schematically since these are well known one skilled in the art and many different shapes and arrangements of the tool head 10 can be used in accordance with technical requirements. A bucking bar 11 is also shown schematically since again this is well known an conventional and many different arrangements can be used.

The tool comprised by the tool head 10 and the bucking bar 11 is used to effect riveting of a conventional domed rivet 13 through two layers of material 14 and 15 at a formed hole 16 so that the material layers are riveted together by the formation of a shop head behind the layer 15 against the bucking tool 11.

The force on the domed head 17 of the universal rivet 13 can be applied by pressure or by repeated impact and again these techniques are well known and the tools for applying the forces are similarly well known.

The present invention relates to the provision of a sheath 20 which engages over the tool head.

The tool head 10 comprises a cylindrical portion 21 extending to a forward end 22 of the cylindrical portion. Forwardly of the point 22, the tool head tapers inwardly to form a frusto conical portion 23 converging inwardly to a forwardmost rib 24 surrounding a recess 25. This shape of the tool head is well known and widely used.

The sheath 20 comprises a generally cylindrical portion 30 which is shaped to match the portions 21 and 23 of the tool head so as to form a sleeve closely surrounding the portions of the tool head. The sheath further includes a recessed portion 31 at the front which is fully closed at the front and follows substantially exactly this shape of the tool head at its front face. Thus the sheath forms a raised rib portion at the rib portion 24 and the recess portion 31 at the recess 25. The thickness of the sheath at the front face of the tool is substantially constant through the recess and over and around the rib. The thickness of the sheath in area to the sides of the tool head is less important and can vary. At the upper edge of the sheath is provided a rib 35 so that the sheath can be manually grasped and slid longitudinally of the tool head as a readily engageable and replaceable sliding fit. A plurality of inwardly projecting elements or nibs 36 is provided on the inside surface of the portion 30 so as to more vigorously engage the outside surface of the tool head in a friction fit. In this way the sleeve can simply slide on to the tool and can simply slide of when worn.

The sheath is formed by injection moulding as an integral mould body.

The thickness of the front portion of the sheath from the angular through the central recess is preferably less than 0.020 inch and more preferably of the order of 0.015 inch. This thickness when combined with the section of a suitable material which is a non-elastomeric material so that it is of low resilience thus differing significantly from rubber, allows the forces from the tool 10 to be applied to the head of the rivet to effect the riveting action while the sheath prevents or inhibits marring of the rivet head or the material on either side of the rivet head by the rib or shoulder of the tool head.

Figure 3:
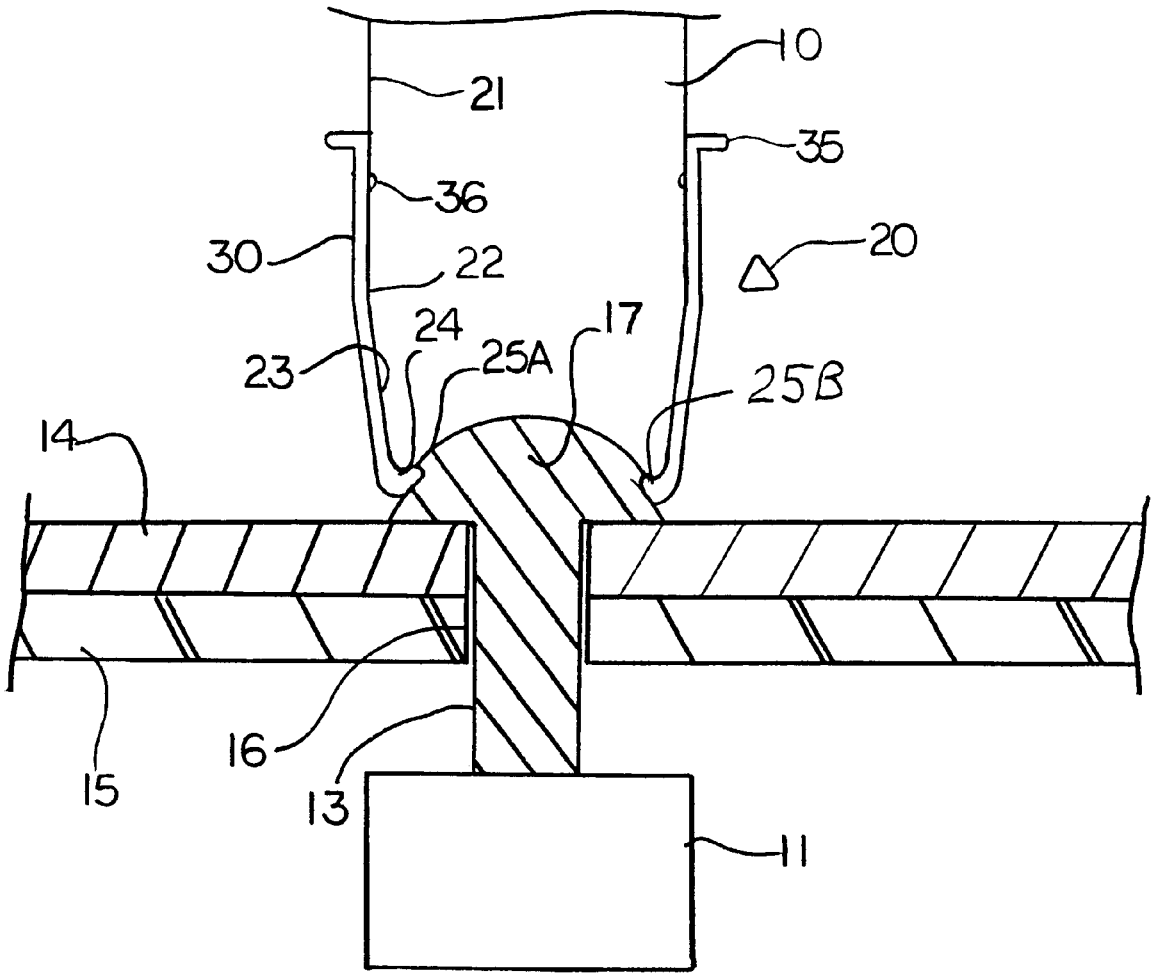
FIG. 3 is a vertical cross sectional view similar to that of FIG. 1 wherein the sheath is modified to include a central hole.

Turning now to FIG. 3, the sheath is modified in that it includes a front annular portion 25B surrounding a central hole 25A at the central circular area within the annular portion 25B which has a diameter less than the front face leaving the peripheral front annular portion 258 surrounding the hole and covering the rib portion 24.

Experimentation has shown that the presence of an excess quantity of material at the central area of the front face can cause the excess material to be compressed causing it to migrate outwardly to the peripheral annular portion where it can cause splitting of the sheath at the peripheral annular portion. This can be overcome either by providing a thickness of the front face which is at the absolute minimum which can be molded or by the solution shown in FIG. 3 where the central portion is totally removed by providing the hole.

The remaining portion at the peripheral edge still effects the required action of preventing the marring which occurs mainly or wholly at the peripheral rib. Where the material at the center is absent or sufficiently thin, it avoids migration of sufficient material to effect splitting. However the material at the rib can migrate inwardly to form a very thin layer over the hole of the order of 0.002 inch thick The material at the rib prevents marring at the rib. The material over the hole prevents damage to the anodised layer on the rivet head thus significantly improving the riveting process and the finished rivet.

Since various modifications can be made in our invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A sheath for a riveting tool, the tool comprising:

a tool head shaped and arranged for engaging and driving a domed rivet head by pressure or impact;

the tool head including a generally cylindrical body with a peripheral wall and a front face for engaging the rivet head, the front face having a central recessed portion and a peripheral rib at or adjacent the peripheral wall;

the sheath comprising:

a body integrally molded from a plastics material;

the sheath having a generally cylindrical sleeve portion for engaging over the peripheral wall of the tool head and extending thereon from the front face to an edge of the sleeve portion partly along the tool head;

the sheath being shaped to provide a readily removable and replaceable friction fit on the tool head so that the cylindrical sleeve portion is slidable over the front face onto the cylindrical portion to be maintained thereon by the friction fit;

the sheath having a front peripheral annular portion shaped to cover the peripheral rib and defining radially inwardly of the front peripheral annular portion a central circular area for extending over the central recessed portion;

and the sheath having a thin film extending radially inwardly from the front peripheral annular portion and filling the central circular area, the thin film being arranged to cover the central recessed portion of the front face of the tool head to prevent damage to the domed rivet head and the thin film being sufficiently thin to prevent material from migrating, during the application of forces to the rivet head, from the thin film to the front peripheral annular portion of the sheath to cause splitting of the front peripheral annular portion.

2. The sheath according to claim 1 wherein the thin film has a thickness of the order of 0.002 inch.

3. A method of applying a rivet to a material to be riveted comprising:

providing a rivet having a shank and a domed rivet head;

providing a material to be riveted having a hole therein for receiving the shank of a rivet;

providing a riveting tool comprising a tool head shaped and arranged for engaging and driving the rivet head by pressure or impact, the tool head including a generally cylindrical body with a peripheral wall and a front face for engaging the rivet head the front face having a central recessed portion and a peripheral rib at or adjacent the peripheral wall;

applying forces to the tool head to apply forces to the rivet head to attach the rivet to the material at the hole;

providing a sheath integrally molded from a plastics material having a generally cylindrical sleeve portion engaged over the peripheral wall of the tool head and extending thereon from the front face to an edge of the sleeve portion partly along the tool head;

the sheath being shaped to provide a readily removable and replaceable friction fit on the tool head so that the cylindrical sleeve portion is slidable over the front face onto the cylindrical portion to be maintained thereon by the friction fit;

the sheath having a front peripheral annular portion shaped to cover the peripheral rib and defining radially inwardly of the front peripheral annular portion a central circular area for extending over the central recessed portion;

preventing marring of the domed rivet head and the material adjacent to the rivet during the application of forces to the rivet head by providing on the sheath a thin film extending radially inwardly from the front peripheral annular portion and filling the central circular area;

preventing damage to the domed head of the rivet by arranging the thin film to cover the central recessed portion of the front face of the tool head;

and preventing splitting of the front peripheral annular portion by causing the thin film to be sufficiently thin to prevent material which would otherwise cause splitting from migrating, during the application of forces to the rivet head, from the film to the front peripheral annular portion of the sheath.

4. A method of applying a rivet to a material to be riveted comprising:

providing a rivet having a shank and a domed rivet head;

providing a material to be riveted having a hole therein for receiving the shank of a rivet;

providing a riveting tool comprising a tool head shaped and arranged for engaging and driving the rivet head by pressure or impact, the tool head including a generally cylindrical body with a peripheral wall and a front face for engaging the rivet head, the front face having a central recessed portion and a peripheral rib at or adjacent the peripheral wall;

applying forces to the tool head to apply forces to the rivet head to attach the rivet to the material at the hole;

providing a sheath integrally molded from a plastics material having a generally cylindrical sleeve portion engaged over the peripheral wall of the tool head and extending thereon from the front face to an edge of the sleeve portion partly along the tool head;

the sheath being shaped to provide a readily removable and replaceable friction fit on the tool head so that the cylindrical sleeve portion is slidable over the front face onto the cylindrical portion to be maintained thereon by the friction fit;

the sheath having a front peripheral annular portion shaped to cover the peripheral rib and defining radially inwardly of the front peripheral annular portion a central circular area for extending over the central recessed portion;

providing an initial hole at the central circular area;

applying forces to the front peripheral annular portion to cause material to migrate from the front peripheral annular portion to cover the central circular area to form a thin film extending radially inwardly from the annular portion and filling the central circular area;

preventing marring of the domed rivet head and the material adjacent to the rivet during the application of forces to the rivet head by providing on the sheath the thin film and the front peripheral annular portion;

and preventing splitting of the front peripheral annular portion by causing the thin film to be sufficiently thin to prevent material which would otherwise cause splitting from migrating, during the application of forces to the rivet head, from the film to the front peripheral annular portion of the tool head.

5. The method according to claim 4 wherein the thin film has a thickness of the order of 0.002 inch.

6. The method according to claim 3 wherein the thin film has a thickness of the order of 0.002 inch.

* * * * *